US007163355B2

(12) United States Patent
Ingle et al.

(10) Patent No.: US 7,163,355 B2
(45) Date of Patent: Jan. 16, 2007

(54) MOBILE WIND-DRIVEN ELECTRIC GENERATING SYSTEMS AND METHODS

(75) Inventors: James E. Ingle, 1942 Limestone Dr., Ellettsville, IN (US) 47429; Douglas Hines, Grapevine, TX (US)

(73) Assignee: James E. Ingle, Ellettsville, IN (US)

( * ) Notice: Subject to any disclaimer, the term of this patent is extended or adjusted under 35 U.S.C. 154(b) by 0 days.

(21) Appl. No.: 11/097,493

(22) Filed: Apr. 1, 2005

(65) Prior Publication Data

US 2005/0260040 A1 Nov. 24, 2005

Related U.S. Application Data

(60) Continuation-in-part of application No. 10/978,510, filed on Nov. 1, 2004, now Pat. No. 7,011,471, which is a division of application No. 10/720,657, filed on Nov. 24, 2003, now Pat. No. 6,981,822, which is a division of application No. 09/835,794, filed on Apr. 16, 2001, now Pat. No. 6,652,194.

(51) Int. Cl.
*E02B 17/08* (2006.01)

(52) U.S. Cl. ..... 405/198; 405/196

(58) Field of Classification Search ..... 405/196, 405/197, 198, 199, 200
See application file for complete search history.

(56) References Cited

U.S. PATENT DOCUMENTS

| | | | |
|---|---|---|---|
| 3,876,181 | A | 4/1975 | Lucas |
| 4,270,877 | A | 6/1981 | Post |
| 4,387,881 | A | 6/1983 | McDuffie |
| 4,411,408 | A | 10/1983 | Radovan et al. |
| 4,479,401 | A | 10/1984 | Korkut |
| 4,521,134 | A | 6/1985 | Schoonmade |
| 4,589,799 | A | 5/1986 | Hotta et al. |
| 4,655,640 | A | 4/1987 | Gillis |
| 4,813,814 | A | 3/1989 | Shibuta et al. |
| 5,139,366 | A | 8/1992 | Choate et al. |
| 5,139,367 | A | 8/1992 | Ingle |
| 5,486,069 | A | 1/1996 | Breeden |
| 5,906,457 | A | 5/1999 | Choate et al. |
| 5,915,882 | A | 6/1999 | Darwiche et al. |
| 6,030,149 | A | 2/2000 | Foo et al. |
| 6,076,996 | A | 6/2000 | Choate et al. |
| 6,231,269 | B1 | 5/2001 | Shear et al. |
| 6,461,081 | B1 | 10/2002 | Legleux |
| 6,564,741 | B1 * | 5/2003 | Nelson ..... 114/264 |
| 6,745,852 | B1 * | 6/2004 | Kadaster et al. ..... 175/5 |
| 6,827,032 | B1 * | 12/2004 | Wobben ..... 114/230.1 |
| 2003/0168864 | A1 * | 9/2003 | Heronemus et al. ..... 290/55 |
| 2005/0134050 | A1 * | 6/2005 | Salls ..... 290/54 |

(Continued)

FOREIGN PATENT DOCUMENTS

| | | |
|---|---|---|
| FR | 2476053 | 8/1981 |

(Continued)

*Primary Examiner*—Frederick L. Lagman
(74) *Attorney, Agent, or Firm*—Brinks Hofer Gilson & Lione

(57) ABSTRACT

A wind-driven source of electricity can be located and oriented to take advantage of winds traveling over water. A structure is provided that can be transported over water and carry one or more wind-driven sources of electricity and structure-supporting means for engaging the earth's surface under water. The structure is transported to an advantageous location for operation of the wind-driven sources of electricity; the structure supporting means is engaged with the earth's surface under water at the advantageous location; and the one or more wind-driven sources of electricity can be elevated to take advantage of the winds traveling over the water.

13 Claims, 9 Drawing Sheets

U.S. PATENT DOCUMENTS

2005/0286979 A1* 12/2005 Watchorn ..... 405/224

FOREIGN PATENT DOCUMENTS

| | | | |
|---|---|---|---|
| JP | 59018808 | A | 1/1984 |
| JP | 60175624 | A | 9/1985 |
| JP | 63044010 | A | 2/1988 |
| NL | 1001094 | | 3/1997 |
| WO | WO 2004070119 | A1 * | 8/2004 |

* cited by examiner

END CYL. STROKE

MID CYL. STROKE

BEGINNING STROKE

MOBILE WIND-DRIVEN ELECTRIC GENERATING SYSTEMS AND METHODS

RELATED APPLICATIONS

This patent application is a continuation-in-part of U.S. patent application Ser. No. 10/978,510, filed Nov. 1, 2004, now U.S. Pat. No. 7,011,471 B2, which is a divisional of U.S. patent application Ser. No. 10/720,657, filed Nov. 24, 2003, now U.S. Pat. No. 6,981,822 B1, which is a divisional of U.S. patent application Ser. No. 09/835,794, filed Apr. 16, 2001, now U.S. Pat. No. 6,652,194 B1.

FIELD OF THE INVENTION

This invention relates to mobile wind-driven generating systems, and more particularly to systems, apparatus and methods by which wind-driven electric generators can be moved and located offshore to take best advantage of offshore and onshore winds.

BACKGROUND OF THE INVENTION

Offshore structures are not unknown. In 1955 the U.S. Army Corps. of Engineers constructed radar stations along the New England coast, which were commonly referred to as "Texas Towers." In constructing these radar stations, the radar platforms were lifted on supporting legs, using hydraulic cylinders. While the legs and the platform were pinned together, a plurality of hydraulic cylinders were manually attached between the supporting legs and the platform. The pins holding the platform stationary with respect to the legs were removed, and the hydraulic cylinders were then pressurized to extend their pistons and raise the radar platform. At the end of the pistons' strokes, the pins holding the platform in position with respect to the supporting legs were manually replaced to hold the platform in a stationary position with respect to the legs so the plurality of cylinders could be disconnected from the platform and the legs, and their pistons could be retracted without affecting the relative positions of the platform and the legs. The plurality of hydraulic cylinders were then manually reattached between the platform and the legs, and the pins holding the platform stationary with respect to the legs were manually removed, and the hydraulic cylinders were operated again to extend their pistons and raise the platform with respect to the legs. This procedure was repeated again and again until the platform was lifted to its desired position with respect to the plurality of legs. This method of construction was labor-intensive, slow, and expensive.

The increasing need for oil and gas has led to offshore exploration, requiring drilling into the earth's surface far below the water. Such drilling operations are accomplished from mobile offshore drilling units (MODUs). MODUs generally comprise submersible, semi-submersible and jack-up types. Jack-up MODUs are massive structures which can have platform surface areas as large as two acres to support the drilling equipment, drilling supplies, power sources, living quarters, helicopter landing ports, and the stores and fuel that are necessary to maintain a drilling crew and operate the MODU and its drilling equipment hundreds of feet above the underwater surface. Jack-up MODUs include a plurality of MODU supporting legs, most generally three legs that are movably engaged with the MODU platform. Following their construction, such MODUs, with their MODU platforms resting on footings at the base of each supporting leg are towed to an offshore drilling site, like a large vessel with three 700 foot masts. Once the MODU is positioned at a drilling site offshore, the MODU supporting legs are lowered to engage the earth's underwater surface and thereafter lift, or jack-up, the MODU platform sufficiently above the water level to reduce exposure of the MODU platform to wave action during severe storms. It is not uncommon for jack-up MODUs to weigh 30,000 to 40,000 tons, or more, with the MODU platform and its variable loads comprising as much as two-thirds of the weight. In addition, it is not uncommon for the MODU supporting legs to have lengths of 600 to 700 feet, and, to provide stability in their support of the MODU platform, to have cross sections, most commonly triangular, up to 50 feet on a side.

The jack-up MODUs currently in use and being constructed include, as the apparatus to adjust the relative position of the MODU platform and MODU supporting legs, a plurality of motor-driven spur gears which engage toothed racks running the length of each corner leg chord of each MODU supporting leg. The leg chords that comprise the corners of the MODU supporting legs of such currently existing jack-up MODUs are constructed with a central toothed rack, of expensive high strength (e.g, 100 KSI) steel, running the length of the supporting leg, with rigidifying semi-circular, tubular structural members welded along both sides of the toothed rack to increase the strength, section modulus and rigidity of the leg chords. Because the spur gears rotationally engage the toothed racks of the leg chords in raising and lowering the MODU supporting legs with respect to the MODU platform, the spur gear teeth and the teeth of the leg chord racks have cycloidal cross sections, and the spur gear drives are each engaged with the leg chord racks by line contact between a single tooth of the spur gear and a single mating tooth of a toothed rack, exposing the teeth of both the spur gear and the rack to extremely high shear forces and requiring that the spur gears and the toothed rack be made of an expensive high-grade steel, with a modulus of elasticity, for example, of 100,000 pounds per square inch (100 KSI).

Because of the great weights being handled and the high stress engagement between the spur gear teeth and rack teeth, as many as 18 spur gear drive units may be engaged with the six toothed racks on each supporting leg. In such systems, the plural spur gear drives are mounted vertically in sets of three units, one above another, so their pinion gears can engage the toothed racks that comprise the leg chords; however, the load is unequally shared by the plurality of engaged pinion gears, the lowest pinion gear and its engaged rack tooth carrying a significantly disproportionate portion of the load.

Because the tooth loading in current spur gear driven jack-up MODUs is approaching the stress and fatigue limits of the available materials, complex controls for the electric motors of the spur gear drives have been developed in an effort to equalize the loads that are borne by the plurality of engaged gears and the associated stresses and fatigue. Such controls control the torques generated by the electric motors to balance the loads on their pinion gears and gradually accelerate and decelerate in an effort to avoid overstressing and fatiguing the engaged teeth. Further, during operation of the spur gear drives, grease must be mopped onto the rack teeth by the MODU crew to reduce the friction between the pinion gears and the leg chord racks, and the grease inevitably falls into the sea.

In addition to requiring expensive controls, materials and manufacturing procedures, spur gear-driven jack-up MODUs also require expensive separate locking apparatus for each supporting leg to maintain the MODU platform in a stationary position with respect to its supporting legs There is also an increasing need for electric energy, and a desire to increase electric generating capacity without the use of fossil fuels, which can pollute the environment. This need has led to "wind farms" in which a multiplicity of wind-driven electric generators and are grouped together in windy locations, such as in the passes of the mountains of Southern California, and in some offshore locations outside of the United States. The wind-driven electric generators in the foreign offshore locations are placed on stationary structures that comprise single tall poles or towers constructed on supporting foundations built on the bottom under the water at the location of the wind-driven generator.

There is, thus, a need for a wind-driven electric generating system that is mobile, and adjustable, permitting the location and elevation of one or more wind-driven electric generators to be adjusted to best take advantage of onshore and offshore winds as a single source of electric power or as one of a multiplicity of sources of electric power in a "wind farm."

BRIEF SUMMARY OF THE INVENTION

The invention provides a new system, method and apparatus for moving, locating and orienting wind-driven electric generators in offshore locations to favorably present one or more wind-driven electric generators for varying wind conditions, singly and in wind farms.

In the invention, a mobile structure that is transportable over water is provided with a plurality of supporting legs that are movable with respect to the mobile structure and with one or more wind-driven electric generators. The mobile structure, supporting legs and one or more wind-driven electric generators are transported over water to a selected offshore location, and the plurality of supporting legs are moved with respect to the mobile structure until they engage the bottom at the offshore location and lift the mobile structure and wind-driven electric generator to an elevation for favorable operation of the wind-driven electric generator by available winds.

Apparatus of the invention comprises a mobile offshore structure, one or more wind-driven electric generators carried by the mobile offshore structure, at least one supporting leg movably engaged with the mobile offshore structure, a linear motion motor, preferably a continuous linear motion motor, for each at least one supporting leg and a control for said linear motion motor whereby operation of said linear motion motor can lift the mobile offshore structure and wind-driven electric generator above the water surface by engaging the at least one supporting leg with the bottom at a selected offshore location. The offshore structure preferably comprises a central portion with a plurality of outwardly extending, leg-engaging portions, each of the leg-engaging portions carrying at least one linear motion motor for driving one of the structure-supporting legs. A single wind-driven generator may be carried by the central portion of the structure or for greater electric power generation, a plurality of wind-driven electric generators can be carried, preferably one by each of the outwardly extending, leg-engaging portions.

In one preferred aspect of the invention, a plurality of continuous linear motion motors are engaged with a plurality of supporting legs to provide continuous relative motion between the mobile offshore structure and its supporting legs, and to also maintain the mobile offshore structure and supporting legs locked in a stationary relationship. As used herein, the preferred "continuous linear motion motor," refers to a plurality of hydraulic piston/cylinder units N whose piston operations are phased so that at most N−1 of the plurality of piston/cylinder units are engaged with a supporting leg and providing relative motion while at least one of the piston/cylinder units is disengaged from the supporting leg and being repositioned for re-engagement with the supporting leg to continue the relative motion. The preferred continuous linear motion motor thus permits a mobile offshore structure and wind-driven generator to be automatically and easily jacked up hydraulically with continuous motion.

In the preferred apparatus of the invention with a plurality of structure-supporting legs, a plurality of hydraulic piston/cylinder units are used to provide continuous relative motion of the mobile offshore structure with respect to a plurality of structure-supporting legs that carry a plurality of toothed racks, by phased operation of their pistons, that is, by sequentially engaging different groups of the piston/cylinder units with the plurality of toothed racks and driving their pistons with hydraulic pressure, while another group of the piston/cylinder units are disengaged from the toothed racks and are repositioned for reengagement by application of hydraulic pressure to the cylinders of the disengaged pistons. The pluralities of hydraulic piston/cylinders in their phased operations provide a plurality of continuous linear motion motors that can be controlled from the mobile offshore structure (or remotely) to jack the mobile offshore structure up or down, and to lock the mobile offshore structure in any stationary position. Such a plurality of continuous linear motion motors are substantially less expensive than a comparable plurality of spur gear drives, which can also be used to provide relative motion between the mobile offshore structure and its supporting legs.

In the preferred apparatus of the invention, a multiplicity of teeth are engaged in providing relative motion (and in lifting the mobile offshore structure) at any given moment of time, eliminating high tooth stress by spreading the load imposed by the weight of the mobile offshore structure and wind-driven electric generator(s) over the multiplicity of teeth provided by a plurality of toothed rack engagement members driven by the plurality of pistons. Furthermore, the teeth of the rack engagement members being driven by the pistons of the hydraulic cylinders, and the teeth of the plurality of racks being driven thereby are preferably formed with substantially planar engagement surfaces that spread the stresses from the driving forces uniformly over and through the engaged teeth, and the substantially planar engagement surfaces of the engaged teeth are preferably angled to be normal to the central axes of the plurality of pistons within the central portion of the pistons' movements.

In addition, where the plurality of piston/cylinder units are pivotally mounted to the mobile offshore structure, the angled substantially planar engagement surfaces of the teeth can generate forces resisting the disengagement of the engaged teeth of the rack engagement members and toothed racks when the pistons are substantially retracted within their cylinders to assist in locking the mobile offshore structure in a stationary position, and the angled substantially planar engagement surfaces of the engaged teeth of the rack engagement members and toothed racks can generate forces assisting the disengagement of the teeth for repositioning of the rack engagement members at the end of the pistons' stroke.

Furthermore, the plurality of driving piston/cylinder units, for at least each leg, are subjected to the same hydraulic pressure when providing relative motion between the MODU and its supporting legs, and any restriction to movement that may result in the exertion of increased pressure on one set of teeth results in increased pressure on all of the acting cylinders, thereby overcoming the restriction to movement without an excessive and unequal force being exerted against any set of teeth.

As indicated above, the preferred apparatus of the invention can further include a locking mode wherein all of the pistons of the plurality of piston/cylinder units are retracted substantially entirely within their cylinders, with their attached toothed rack engagement members engaged with the toothed racks, and providing, in their engagement, forces resisting their disengagement. The locking mode of operation eliminates the expensive separate locking apparatus for each supporting leg that are necessary in current spur gear driven jack-up systems.

Preferred methods of the invention include:

A method of locating a source of electricity to take advantage of wind traveling over water, comprising providing a structure that can be transported over water, providing one or more wind-driven sources of electricity carried by said structure, providing structure-supporting means carried by said structure for engaging the earth's surface under water, transporting the structure to an advantageous location for operation of the wind-driven sources of electricity, engaging said structure-supporting means with the underwater earth's surface at the advantageous location and elevating the one or more wind-driven sources of electricity to take advantage of the winds traveling over the water.

A method of elevating a wind-driven electric generator at an offshore location, comprising: providing a plurality of supporting legs for the wind-driven electric generator; providing a plurality of toothed racks fastened to said plurality of supporting legs; providing a plurality of hydraulic piston/cylinder units connected with said wind-driven electric generator, each of said plurality of hydraulic piston/cylinder units having a toothed rack engagement member attached to and driven in a vertical direction by its piston and engageable with one of said toothed racks; engaging a portion of the plurality of said toothed rack engagement members of a portion of said plurality of piston/cylinder units with said toothed racks; and driving said engaged portion of the plurality of toothed rack engagement members by applying hydraulic pressure to said pistons of said portion of the plurality of piston/cylinder units to extend the pistons and thereby continuously provide relative motion between the wind-driven electric generator and supporting legs while a remainder of the toothed rack engagement members are disengaged from the toothed racks and are being repositioned for re-engagement by applying hydraulic pressure to retract their pistons and thereafter for driving the toothed racks.

Further inventive features and combinations are presented in the drawings and more detailed descriptions of the invention that follow.

BRIEF DESCRIPTION OF THE DRAWINGS

FIG. 1A being an illustration from the side, and FIG. 1B being an illustration from above.

DETAILED DESCRIPTION OF THE INVENTION

Figure 1A:
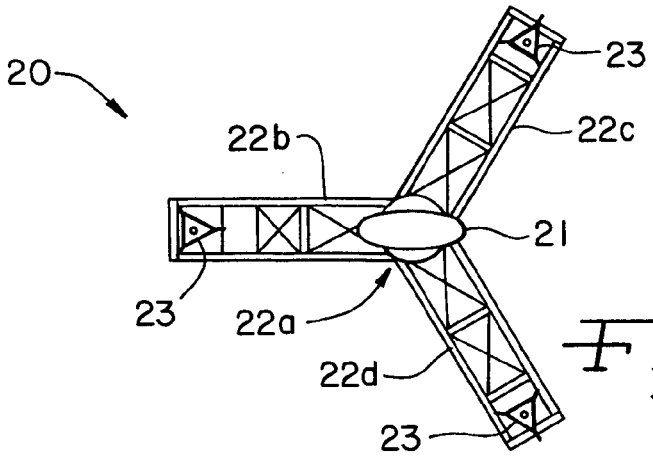
FIGS. 1A and 1B are diagrammatic illustrations of a mobile offshore structure and wind-driven electric generator in position offshore.
Figure 1B:
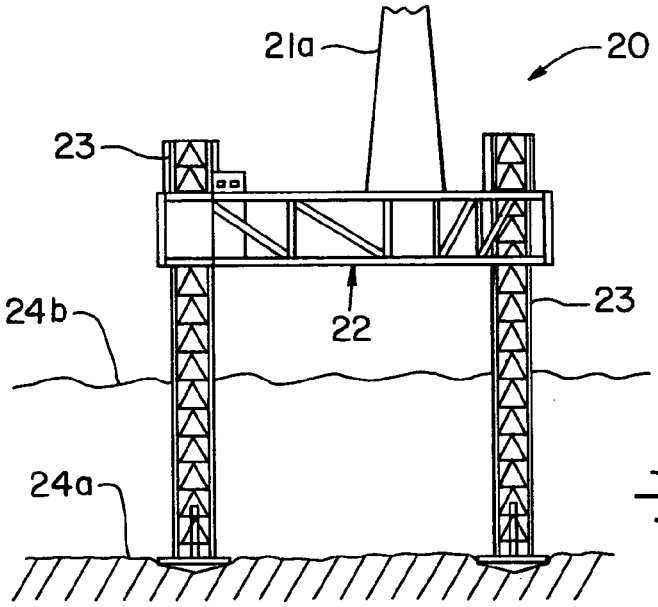

FIG. 1A and FIG. 1B illustrate a system and apparatus 20 for the offshore generation of electricity by means of a source of electricity, such as a wind-driven generator 21. FIG. 1A is a diagrammatic illustration of the system and apparatus 20 from the side, and FIG. 1B is a diagrammatic illustration of the system and apparatus 20 from above. As illustrated by FIGS. 1A and 1B, the apparatus comprises, in addition to the wind-driven generator 21 and its support 21*a*, a mobile structure 22 and a plurality of legs 23 for supporting the offshore structure 21 from the earth's surface 24*a* under the water. The supporting legs 23 movably engage the offshore structure 22 and the system and apparatus includes means to move the supporting legs 23 relative to the mobile structure 22, one preferred such means being illustrated in FIGS. 3–15 and described in greater detail below.

As illustrated in FIG. 1A, the mobile structure 22 is supported by the supporting legs 23 from the earth's surface 24*a* substantially above the water level 24*b*. In the method of generating electricity according to the invention, the system and apparatus 20 is constructed onshore by providing and building the mobile offshore structure 22 and providing the mobile offshore structure 22 with at least one, and preferably a plurality, of supporting legs 23 that are movably engaged with the mobile offshore structure 22 in substantially the same manner as is well-known in the construction of mobile offshore drilling units (MODUs). The mobile offshore structure 22 is also preferably provided with one or more wind-driven generators 21, which are carried and supported by the mobile offshore structure 22. The mobile offshore structure 22 is constructed to be buoyant and is transported with the supporting legs and the one or more wind-driven generators over the water (e.g., by being towed) to an offshore location where the plurality of supporting legs are moved by drive means with respect to the mobile offshore structure 22 until they engage the bottom (e.g., 24*a*) at a selected offshore location, and the movement of the plurality of supporting legs is continued to lift and orient the mobile offshore structure 22 and wind-driven generator 21 at an elevation for favorable operation of wind-driven generator by available winds. As best seen in FIG. 1B, the mobile offshore structure 22 comprises a central portion 22*a* with a plurality of outwardly extending, leg-engaging portions 22*b*, 22*c* and 22*d*, and adjacent the ends of the plurality of outwardly extending, leg-engaging portions, each of the plurality of outwardly extending, leg-engaging portions 22*b*, 22*c* and 22*d* movably engages one of the plurality of supporting legs 23, as illustrated, for example, in FIG. 1C. The mobile offshore structure 22 can be provided with tanks which can be used to provide buoyancy and to preload its supports on location.

Figure 1C:
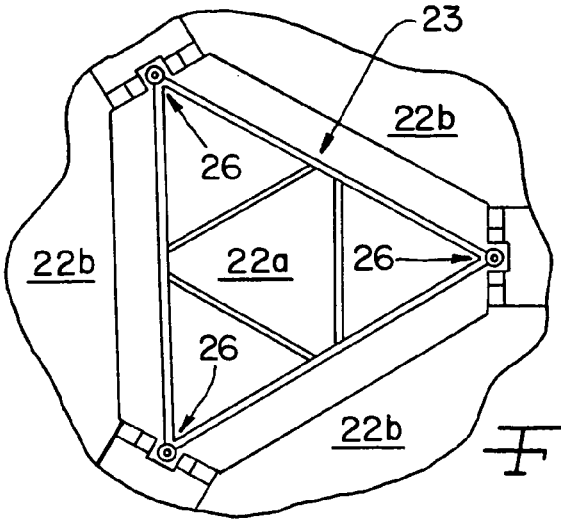
FIG. 1C is a view from above of the structure and one of its supporting legs to illustrate the relationship between the structure and its supporting legs.

FIG. 1C is a view from above one of the supporting legs 23 to illustrate how the supporting legs 23 and the mobile offshore structure 22 are movably engaged. As illustrated by FIGS. 1A, 1B and 1C, each of the plurality of supporting legs 23 can be comprised of three leg chords 26, at the three corners of a triangular supporting leg 23. The three leg chords 26 are welded into a supporting leg structure 23, which may be of any configuration that provides sufficient strength to carry the weight of the mobile offshore structure 22 and one or more wind-driven generators 21, and other ancillary supporting structures and supplies. Each of the three supporting legs 23 extend through an opening 22*a* at the ends of the outwardly extending leg-engaging portions 22*b*, 22*c* and 22*d* of the mobile offshore structure 22.

Figure 4:
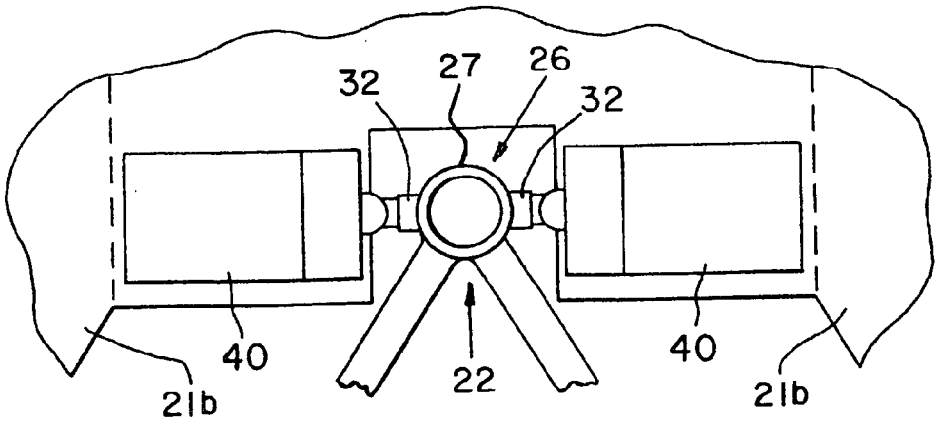
FIG. 4 is a view taken from above FIG. 3.

In the embodiment, which is illustrated in FIG. 4, each of the leg chords preferably comprises a cylindrical tubular column 27 with toothed racks 32 welded on opposite sides and positioned for engagement by drive motors, such as the continuous linear motion motors 30 to be described below, which can operate to provide continuous relative motion between the mobile offshore platform 22 and the plurality of supporting legs 23, and to lock the mobile offshore platform 22 into a stationary position with respect to the supporting legs 23, when desired. The peripheral outer surface of the cylindrical tubular member 27 of each leg chord 26 of each supporting leg 23 can be slidably engaged with bronze bushings (not shown) carried by the mobile offshore structure 22 as needed to prevent lateral relative motion between the mobile offshore structure 22 and the plurality of supporting legs 23.

Figure 2:
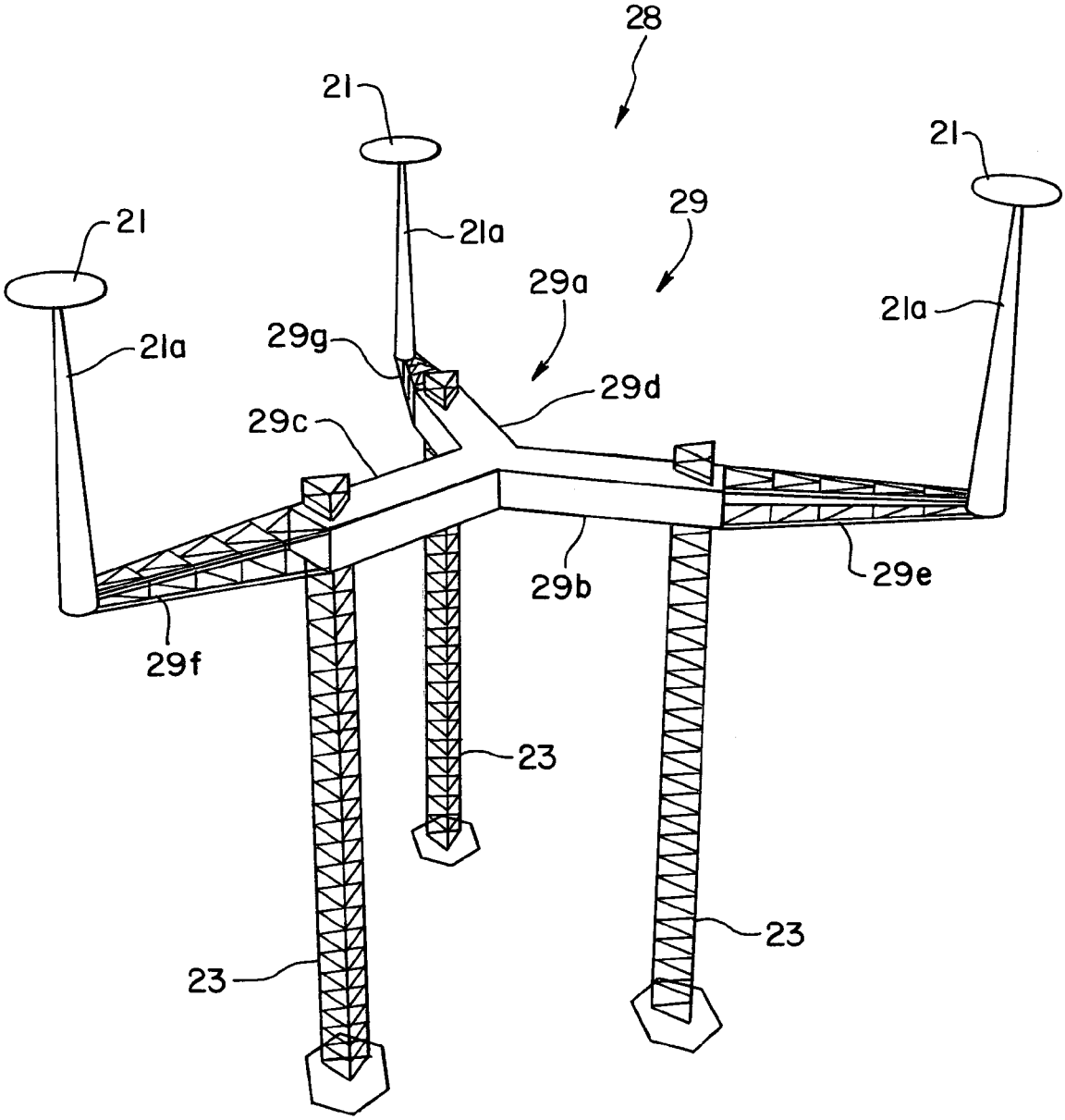
FIG. 2 is perspective illustration of a mobile offshore structure and a plurality of wind-driven electric generators, to illustrate the relationship between the mobile offshore structure and its supporting legs.

FIG. 2 is a perspective diagram of a system and apparatus 28 of the invention for carrying, locating and orienting three wind-driven generators 21. As illustrated by FIG. 2, the system and apparatus 28 includes a larger mobile offshore structure 29 movably carried by a plurality of supporting legs 23 as described above. As illustrated, the mobile offshore structure 29 of the system and apparatus 28 of the invention comprises a central three-legged, Y-shaped portion 29*a*, extending between and engaging three structure supporting legs 23. Each leg, 29*b*, 29*c* and 29*d*, of the Y-shaped portion 29*a* carries at least one drive means for providing relative motion between the mobile offshore structure 29 and one of the structure supporting legs, as will be described below. In order to accommodate three wind-driven generators 21, the mobile offshore structure 29 further comprises a supporting structure 29*e*, 29*f*, 29*g* on each leg 29*b*, 29*c*, 29*d* of the Y-shaped portion 29*a*, each of said supporting structures 29*e*, 29*f* and 29*g* carrying a wind-driven electric generator 21 and its support 21*a*.

System and Apparatus 20 of the invention, such as those illustrated in FIGS. 1A and 1B and FIG. 2, can carry one or more wind-driven generators, which can each provide as much as five megawatts and weigh as much as several hundred tons, in ocean depths over 100 meters. The larger type system and apparatus 28 illustrated by FIG. 2 can carry, for example, three 3.6 megawatt wind-driven generators in ocean depths of 120 meters.

As indicated above, the preferred apparatus of the invention includes a plurality of continuous linear motion motors 30 engaged with the plurality of supporting legs 23 to provide continuous relative motion between the mobile offshore structure 22, 29 and its supporting legs 23. The preferred "continuous linear motion motor" comprises a plurality of hydraulic piston/cylinder units N whose piston operations are phased so that at most N−1 of the plurality of piston/cylinder units are engaged with a MODU-supporting leg 22 and providing relative motion while at least one of the piston/cylinder units is disengaged from the supporting leg 23 and is being repositioned for re-engagement with the supporting leg 23 to continue the relative motion. Continuous linear motion motors can comprise any number of piston/cylinder units necessary to provide relative motion between the mobile offshore structure 22, 29 (and its wind-driven generator(s)) and its supporting legs 23 in acting on one or more toothed racks; however, it is believed to be preferable that the plurality of hydraulic piston/cylinder units in the continuous linear motion motor comprise an even number of units divided into two sets of piston/cylinder units acting on two toothed racks 32 on opposite sides of a leg chord 30, as shown in FIGS. 3–8, to minimize the imposition of transverse shear stresses in the leg chord 26 and toothed racks 32. Toothed racks as used herein means one member or a plurality of members, forming a plurality of tooth engagement surfaces which are capable of accepting the imposition of driving forces sufficient to provide relative motion between a mobile offshore structure 22, 29 and a supporting leg 23. Preferably, toothed racks comprise a plurality of teeth uniformly formed along one side, particularly with a plurality of teeth having angled planar engagement surfaces capable of spreading the stresses due to the driving force necessary for relative motion uniformly throughout the teeth, as described in greater detail below.

Because the number of hydraulic piston/cylinder units that may comprise a continuous linear motion motor is not limited in this invention, it is unnecessary to use expensive specially designed or sized hydraulic piston/cylinder units or hydraulic pumps, and the hydraulic piston/cylinder units and hydraulic pumps may be selected from the inexpensive, commercially available "standard" hydraulic piston/cylinder units and pumps. Such continuous linear motion motor jack-up systems can be made for much less than comparable spur gear driven jack-up systems of comparable lifting capacity, and are preferred for this reason and those explained below.

Figure 3:
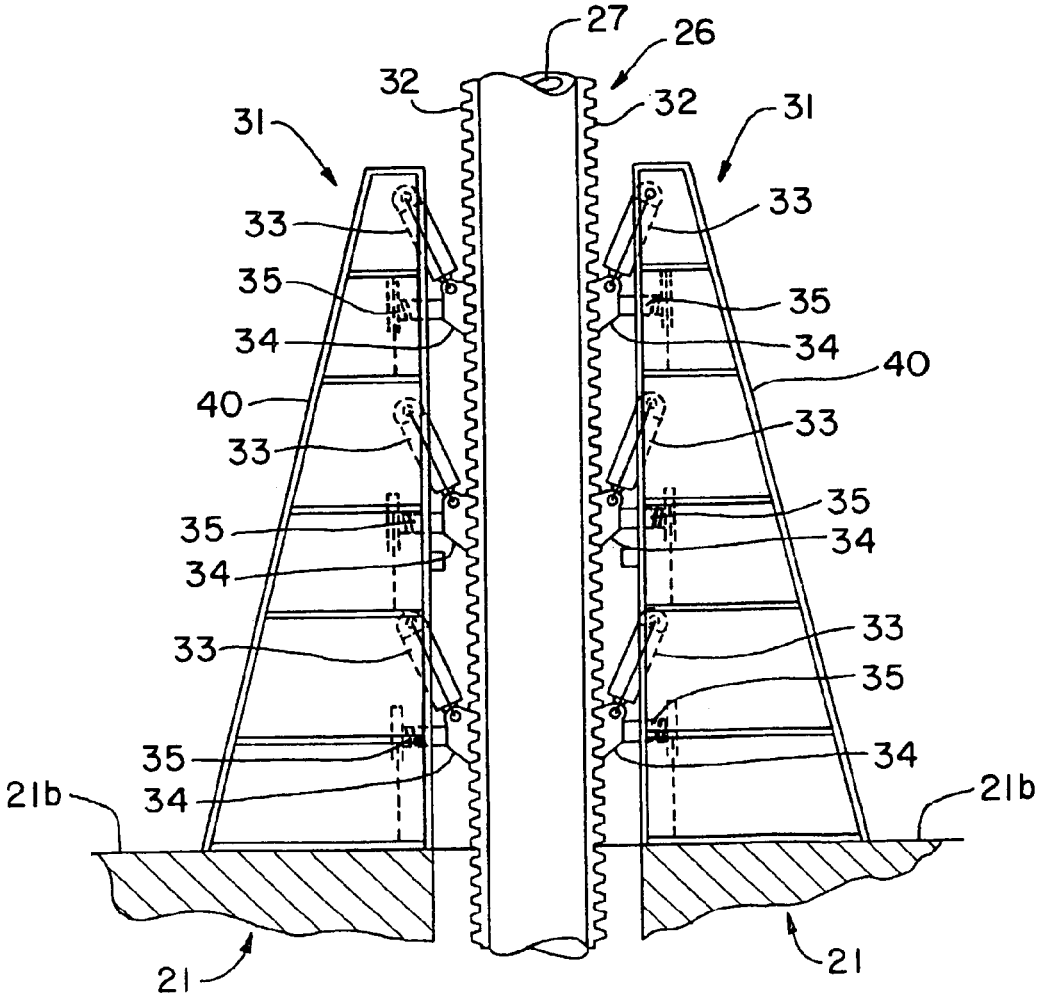
FIG. 3 illustrates a continuous linear motion motor (and its supporting structure) and the engagement of its plurality of piston/cylinder units with a toothed rack and leg chord, with the piston/cylinder units in their locked position.
Figure 3B:
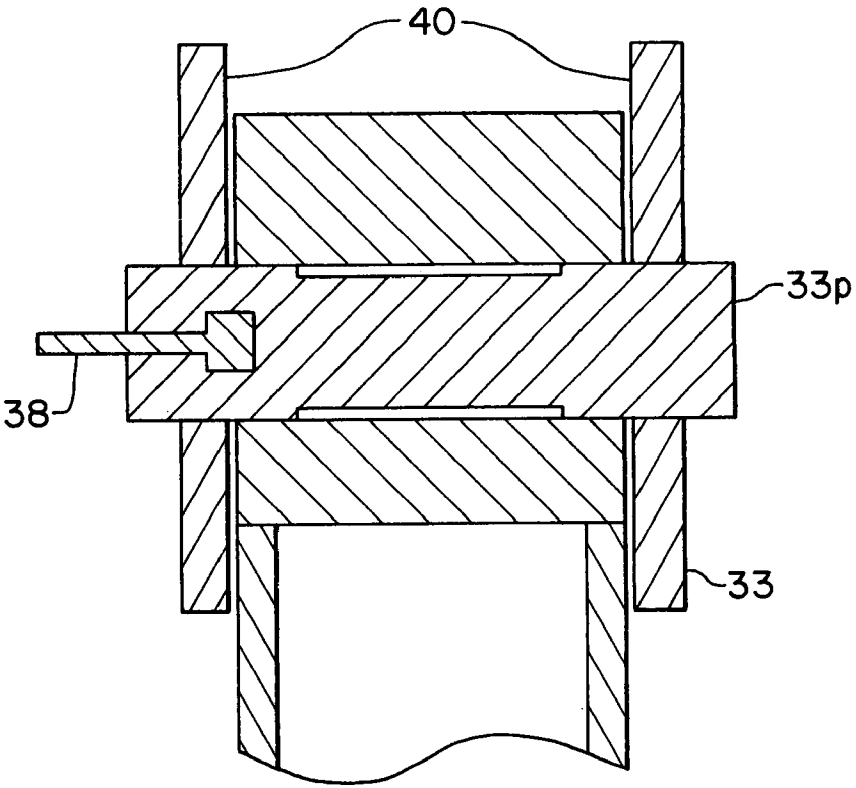
Figure 3A:
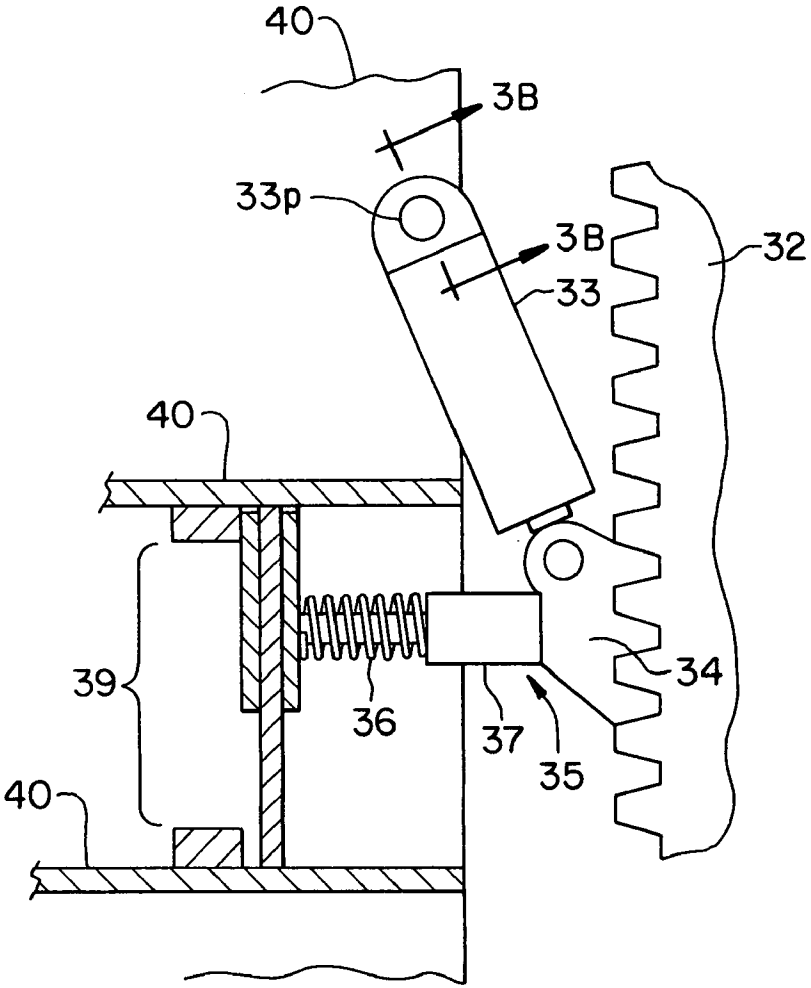

FIG. 3 illustrates, as an example, a continuous linear motion motor 30 comprising two sets 31 of three piston/cylinder units 33 each to provide continuous relative motion between the mobile offshore structure 22, 29 and the illustrated one of its supporting legs 23. Each of the piston/cylinder units 33 comprises a double-acting hydraulic cylinder, with a piston moving in response to hydraulic pressure applied at the ends of its cylinder to move outwardly from its cylinder and to retract inwardly within its cylinder. FIG. 3 illustrates the pistons of the piston/cylinder units 33 in their retracted position with their pistons substantially entirely enclosed within their cylinders. Each of the pistons of the plurality of piston/cylinder units 33 has a toothed rack engagement member 34 attached to its end and engaged, under the action of an engagement/disengagement means 35, with one of the toothed racks 32, thereby locking the mobile offshore structure 22, 29 in a stationary position with respect to its supporting legs 23. Because, in the invention, the continuous linear motion motors and their pluralities of piston/cylinder units can effectively lock the mobile offshore structure 22, 29 in a stationary position with respect to its supporting legs, the need for the separate expensive platform leg locking apparatus used in the spur gear driven jacking systems is unnecessary, providing a substantial cost savings. The structure of the supporting legs 23, except for the one illustrated leg chord 26 and toothed racks 32, have been omitted from FIG. 3 in order to better illustrate the plurality of cylinders 33 and the engagement of their toothed-rack engagement members 34.

The plurality of piston/cylinder units 33 comprising the continuous linear motion motors 30 that move the supporting leg 23 with respect to the mobile offshore structure 22, 29 are pivotally attached to and carried by structural towers 40 on the mobile offshore structure 22, 29 adjacent the leg chords 26 of the supporting legs. The mobile offshore structure 22, 29 The mobile offshore structure 22, 29 includes structural members, as known in the art, to bear the load associated with the engagement of the mobile offshore structure 22, 29 and its plurality of supporting legs 23.

The continuous linear motion motor 30 includes a plurality of means 35 for the engagement and disengagement of the toothed shoes 34 of the piston/cylinder units 33 with the toothed racks 32 by pivoting the piston/cylinder units 33 through a small angle. The engagement/disengagement means 35 for the rack engagement members 34 preferably comprise compression springs that act on the rack engagement members 34 to urge them toward and into engagement with the toothed racks 32, and unclamp hydraulic piston/cylinder units acting in response to the imposition of hydraulic pressure within their cylinders to overcome the forces of the compression springs, moving the rack engagement members away and disengaged from the toothed racks 32. Such engagement/disengagement means 35 preferably comprise single-acting piston/cylinder units including a compression spring within the cylinder acting on one side of the piston to push it outwardly from the cylinder in the absence of pressure, with the application of pressure on the other side of the piston overcoming the force of the compression spring and moving the piston into the cylinder. With such preferred engagement/disengagement means, no power is required to engage and maintain the engagement of the toothed rack engagement members 34 with the toothed racks 32 in the locked mode; however, other controllable engagement/disengagement means, such as double acting hydraulic piston/cylinders, electric actuators and the like, may be used.

As described in greater detail below, the tooth profiles of the teeth of the toothed shoes 34 and of the teeth of the toothed racks 32 and the pivotal attachment of the cylinders 33 cooperate when the jacking system is in its locked mode with the pistons of piston/cylinder units 33 retracted into their cylinders to generate engagement forces assisting the engagement/disengagement means 35 in maintaining the toothed shoes 34 in engagement with the toothed racks 32 and maintaining the mobile offshore structure 22, 29 locked into a stationary position with respect to its supporting legs 23.

To simplify explanation of the operation of continuous liner motion motors two sets of three active hydraulic piston/cylinder units 33 are illustrated and described as comprising a continuous linear motion motor 30. It must be understood, however, that any plurality of piston/cylinder units N may comprise a continuous linear motion motor in the invention, provided their operation is sequentially phased, as, for example, illustrated in FIGS. 9 and 10, so that at most N−1 of the piston/cylinder units are engaged with a toothed rack and are providing relative motion between the mobile offshore structure 22, 29 and the its supporting legs 23 while at least one of the piston/cylinder units is being retracted and repositioned for reengagement with and driving of the supporting leg.

FIGS. 5–9 illustrate the phased operation of the three piston/cylinder units 33*a*, 33*b* and 33*c* of each set 31 to provide continuous linear motion acting on a leg chord 26 of one of the supporting legs 23.

In providing continuous linear motion, the piston strokes of each of the piston/cylinder units 33*a*, 33*b* and 33*c* of each set 31, and the engagement and disengagement of their toothed rack engagement means 34 are phased, that is, their operations are displaced in time so that two of the piston/cylinder units have their rack engagement members 34 engaged with the toothed racks 32 of a leg chord 26 with their pistons being extended to drive the leg chord 26 while the third piston/cylinder unit has its rack engagement member 34 disengaged from the toothed rack 32 of the leg chord 26 with its piston being retracted to reposition its rack engagement member 34 for reengagement with the toothed rack 32 and subsequent extension of its piston to drive the leg chord 26. This repetitive phased operation of the piston/cylinder units 33 to achieve linear motion is illustrated in the phase diagram FIG. 9.

Figure 5:
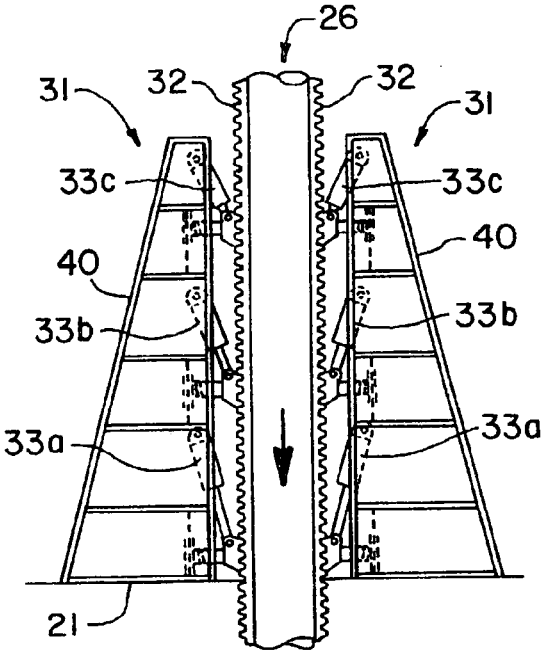
FIGS. 5–9 illustrate the phased operation of two sets of three hydraulically driven piston cylinder units to effect continuous linear motion, FIG. 9 comprising a phase diagram for the operations of the pistons as illustrated by FIGS. 5–8.
Figure 6:
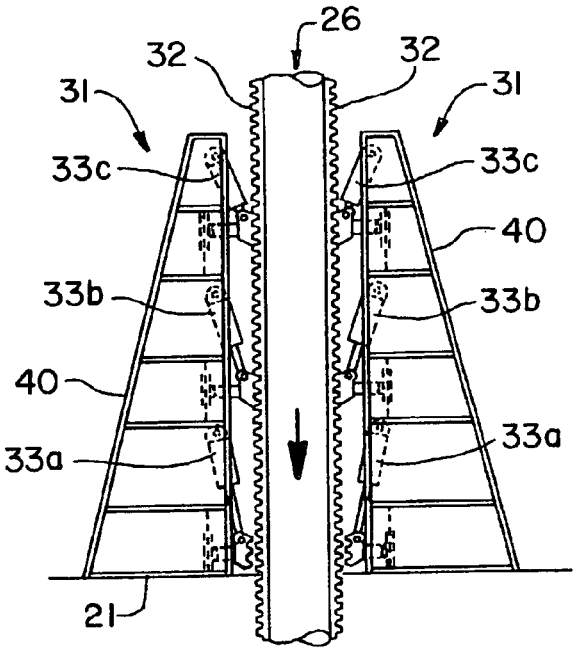
Figure 7:
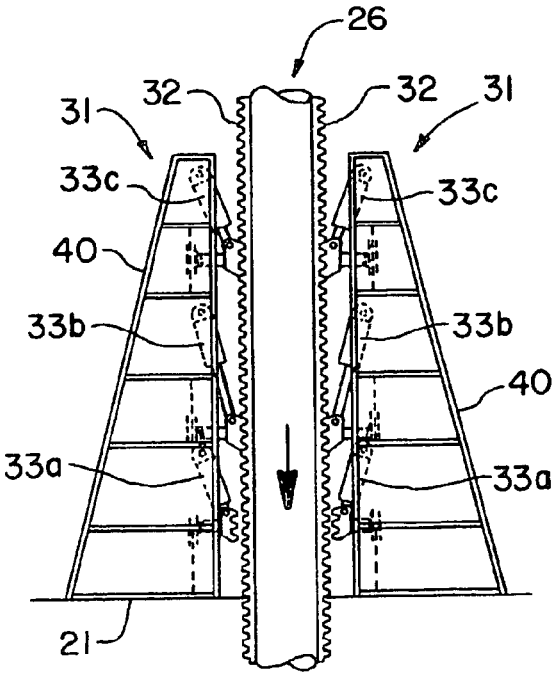
Figure 8:
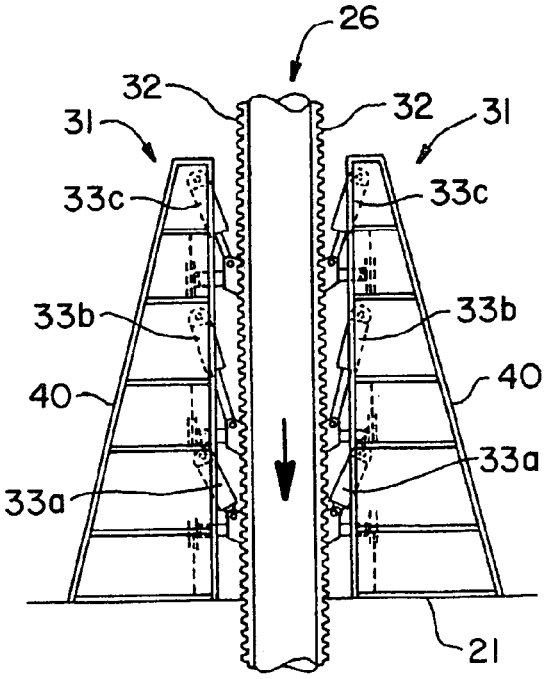
Figure 9:
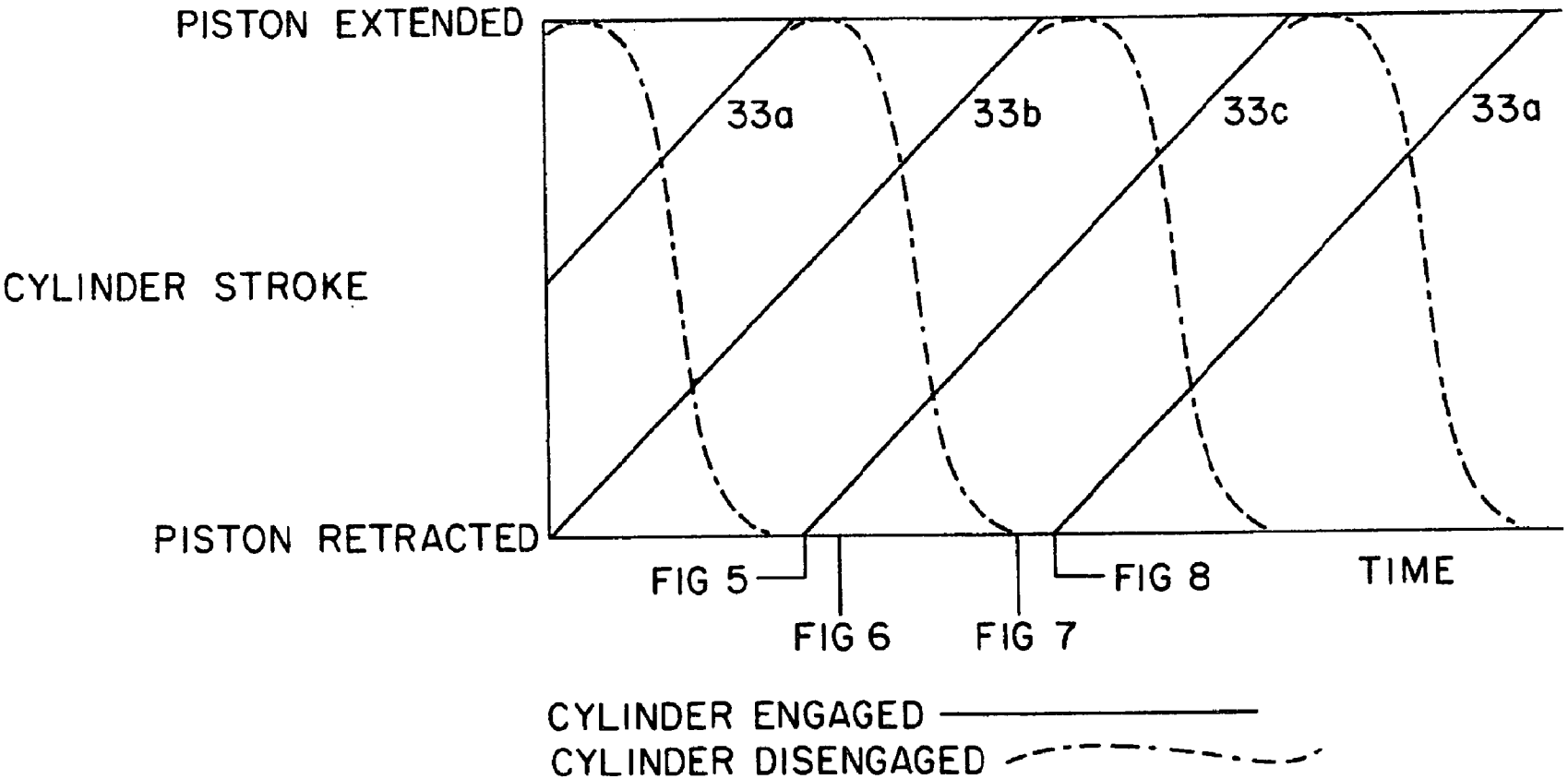

At the point in time illustrated on FIG. 9 by the notation FIG. 5, the piston/cylinder units 33*a*, 33*b* and 33*c* have been driven so the pistons of piston/cylinder units 33*a* are fully extended, the piston/cylinder units 33*b* are in mid-stroke, and the piston/cylinder units 33*c* have just been engaged with toothed racks 32. At the point in time illustrated by FIG. 6 on the phase diagram of FIG. 9, the rack engagement members 34 of piston/cylinder units 33*a* have been disengaged from the toothed racks 32, while piston/cylinder units 33*b* and 33*c* continue to drive toothed racks 32 and leg chord 26 to the point illustrated in FIG. 7. At the point in time illustrated by FIG. 7, the pistons of piston/cylinder units 33*a* have been retracted and the rack engagement members 34 of piston/cylinder units 33*a* have been positioned for reengagement with the toothed racks 32, the piston/cylinder units 33*b* have been operated until their pistons are fully extended and the piston/cylinder units 33*c* have been operated until their pistons are in mid-stroke. Shortly after this time, as illustrated in FIG. 8, the rack engagement members 34 of piston/cylinder units 33*a* are reengaged with the toothed racks 32 as the pistons of piston/cylinder units 33*b* approach full extension and as the pistons of piston/cylinder units 33*c* are in mid-stroke. This phased operation of the toothed rack engagement members 34 by their engagement/disengagement means 35 and of the pistons of piston/cylinder units 33*a*, 33*b* and 33*c* continues in time, as indicated by FIG. 9, continuously driving (without interruption) the supporting legs 23 with respect to the mobile offshore structure 22, 29.

Figure 10:
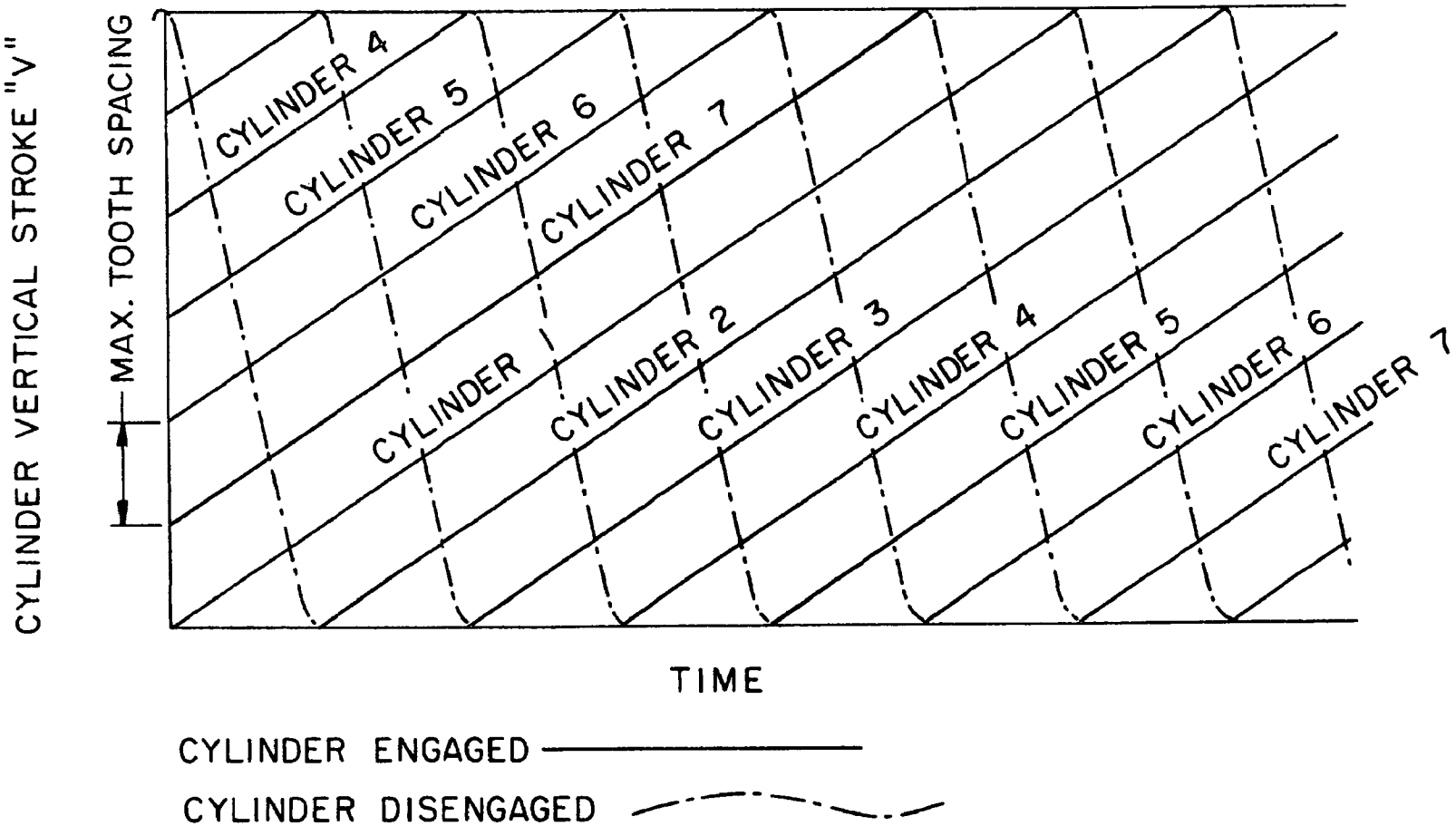
FIG. 10 is a phase diagram of seven piston/cylinder units operating to provide continuous linear motion.

As indicated above, it is not necessary that the continuous linear motion motors comprise sets of three piston/cylinder units, and in practical application, because of the substantial forces that are required to move the weights of a mobile offshore structure 22, 29 and wind-driven generator(s) and other loads that it carries, and the supporting legs with respect to each other, continuous linear motion motors incorporated into mobile offshore structure jacking systems may comprise substantially more than three piston/cylinder units each. FIG. 10, for example, comprises a phase diagram of the operation of a seven piston/cylinder unit motor. With larger numbers of piston/cylinder units in a motor, the stress created in the teeth of the jack-up system and the time during which any single piston/cylinder unit is disengaged from the supporting legs is reduced. In addition, although FIGS. 3–8 illustrate an even number of piston/cylinder units 33 acting in pairs on the opposing toothed racks 32 of a leg chord 26, the number of piston/cylinder units acting on the toothed racks of a single leg chord can be an odd number, so long as the number of piston/cylinder units N are phased so that at most N−1 piston/cylinder units are engaged with and driving the leg chords of the a supporting leg while at least one of the piston/cylinder units is being retracted for subsequent engagement. Where an odd number of piston/cylinder units is engaged with the toothed racks of a single leg chord, their positions of engagement with the toothed racks of the leg chords should be staggered, rather than opposing, as illustrated in FIGS. 3–8. While the staggered odd number of piston/cylinder units acting on toothed racks imposes shear forces acting transversely on the toothed racks and leg chord, the forces acting normal to the central axis of the leg chord and its toothed racks are not large and will impose no unacceptable shear stress on the toothed racks and leg chord.

Figure 11:
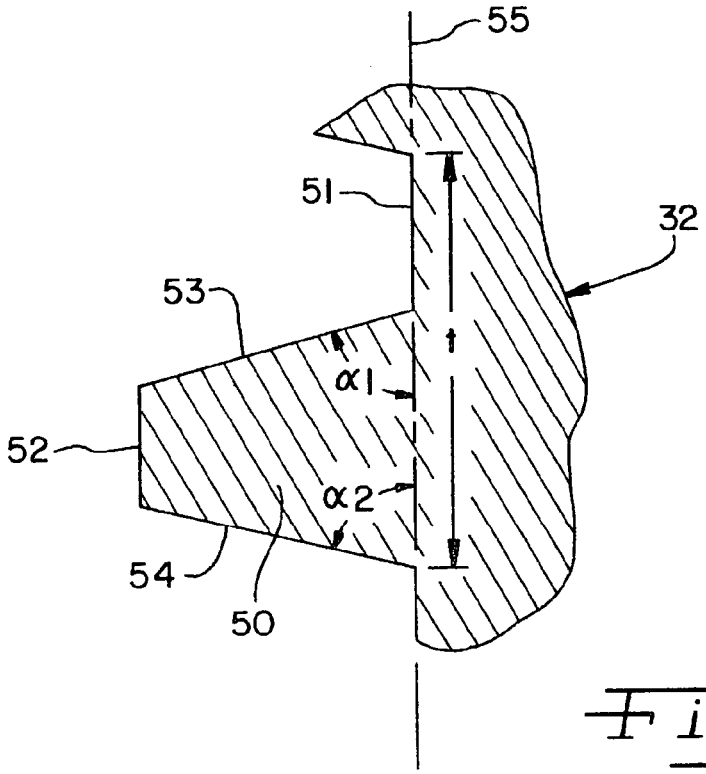
FIG. 11 is a cross-sectional illustration of a preferred tooth profile of the invention.

Another feature of the invention comprises the tooth profile preferably employed in the rack engagement members 34 and the toothed racks 32. FIG. 11 illustrates, in cross section, a tooth 50 with a profile that is preferably incorporated into the teeth of the rack engagement members 34 and toothed racks 32. While the preferred tooth 50 is illustrated in FIG. 11 as one of the teeth of the toothed rack 32, the mating teeth of the toothed rack engagement members 34 will have the same mating tooth profile. In practice the toothed racks are wide, having widths as large as 7–10 inches, and the load bearing surfaces of the tooth 50 extend in directions perpendicular to the surface of the paper.

As indicated by FIG. 11, the tooth profile of a preferred tooth 50 includes flat and substantially vertical root and cap surfaces 51 and 52, respectively, and a pair of angled planar engagement surfaces 53 and 54, forming with respect to a substantially vertical plane 55 that includes the roots 51 of the teeth, tooth angles $\alpha 1$ for the planar upper tooth surface 53 and $\alpha 2$ for the lower planar tooth surface 54. While it is preferable that the tooth engagement surfaces 53 and 54 of tooth 50 be purely planar, manufacturing techniques, such as the use of cutting torch methods, introduce deviations from the preferred purely planar form. Further references to the "planar" surfaces of the tooth 50 include surface imperfections and variations from purely planar that do not alter the reduced stress concentration benefits of this invention. For ease of manufacture, the angles $\alpha 1$ and $\alpha 2$ are preferably equal angles, although the angle of $\alpha 2$ of the lower engagement surface 54 may be increased to decrease the disengagement forces when the supporting legs 23 and their inner racks 32 are moved upwardly with respect to the mobile offshore structure 22, 29. Importantly, the angle $\alpha 1$ for the upper planar engagement surfaces 53 of the toothed racks 32 is selected so that when the mating teeth of the rack engagement members 34 are being driven by the piston/cylinder units 33 in mid-stroke, the forces imposed on the upper angled planar engagement surfaces 53 of the toothed racks 32 by the mating engaged teeth of the rack engagement members 34 is substantially perpendicular to the upper planar engagement surfaces 53 of the rack teeth 50. Because the engagement surfaces of the teeth of the rack engagement members 34 and the engagement surfaces of the teeth of the toothed racks 32 are planar, the stresses resulting from the driving forces on the engaged teeth of the rack engagement members 34 and toothed racks 32 are uniformly spread over the engaged surfaces and within the bodies of the teeth.

As well known in the art, the number of toothed racks and engaged teeth necessary to carry the maximum weight W of the mobile offshore structure and all of its topside loads may be determined by $$S \times T \times N \geqq W$$

where S is the acceptable tensile stress of the material from which the engaged teeth will be manufactured, T is the total root area of the engaged teeth of each toothed rack and N equals the number of toothed racks. The total root area T equals the tooth pitch t (FIG. 11) of the engaged teeth times the number n of the engaged teeth (i.e., t×n). The total root area T may comprise as large an area as necessary to permit the use of readily available and inexpensive steels having modulii of elasticity, for example, on the order of 34–58 KSI, thereby eliminating the requirement for use of the special high strength steels required by the spur gear drive systems of the prior art.

In a continuous linear motion motor the geometric relationship of tooth pitch, vertical cylinder stroke, vertical distance between base mounting pins of cylinders, number of cylinders used, and cycling arrangement must meet certain geometric criteria for satisfactory operation. When configured as described below, the jacking operation will move the legs 23 of the apparatus of the invention up or down in relationship to the mobile offshore structure 22, 29 and will lock the legs in position for extended periods for drilling operations or for transit.

A typical calculation to determine the geometry of a specific jack-up design follows:

Let:

N=number of cylinders (or cylinder pairs) required at each leg chord to raise the jack-up platform;

V=vertical travel of the tooth (or teeth) engaged with the chord rack;

D=vertical distance between base pins of cylinders, i.e., mounting distance;

T=required tooth pitch of rack;

t=individual tooth pitches smaller than required tooth pitch may be attained by dividing "T" by 2, 3, 4, etc.;

S=cylinder stroke.

Since the cylinder may be mounted with the cylinder base pin outboard from the rod end pin, "S" will be larger than "V".

Typical Calculation Example

| | |
|---|---|
| Step 1: Calculate the total number of cylinders required at each leg to raise the mobile offshore structure and its load, including safety factor. The number of cylinders must be evenly divisible by the number of leg chords. This result must be the next higher even number. | 54 cylinders in sets of 2 |
| Step 2: Divide the number of cylinders by the number of leg chords. (9 leg chords for 3 triangular legs) | 54/9 = 6 In sets of 2 |
| Step 3: Add one set of cylinders per leg chord | 6 + 1 = 7 sets of cylinders per leg chord |
| Step 4: Select the desired tooth pitch "T" by calculating acceptable bearing stresses on the leg chord teeth. | 3 inch pitch |
| Step 5: Multiply the tooth pitch "T" by the number of cylinders on each leg chord to find "V". | V = T * 7<br>V = 3 * 7<br>V = 21 inches |
| Step 6: Calculate "D" by subtracting maximum tooth | D = V − T<br>D = 21 − 3 |

-continued

| |
|---|
| pitch from the vertical travel of the tooth engaged D = 18 inches with the chord rack. |
| Step 7: |
| The piston travel S is then determined from the result and the mounting geometry. |

FIG. 10 illustrates the correlation between the vertical cylinder stroke V and the maximum tooth pitch, or spacing T for a seven piston/cylinder unit motor.

Other possibilities exist for determining numbers of cylinders or for determining workable tooth pitch "t". Odd numbers of cylinders may be advantageous for some designs which will require the cylinders to act individually and alternately along the leg chord with the mounting of the cylinders determined in a similar manner as described in the above calculation to establish the proper geometry for cylinder position and tooth pitch.

The following table further illustrates the relationship between the number of phased piston/cylinder units and tooth spacing.

SYSTEM PHASE VS. TOOTH SPACING

| SYSTEM PHASE | 120 DEGREE | 90 DEGREE | 72 DEGREE | 60 DEGREE |
|---|---|---|---|---|
| NO. CYL. OR CYL. PAIRS-N | 3 | 4 | 5 | 6 |
| VERTICAL STROKE-V | V | V | V | V |
| MAX TOOTH SPACING-T | V/(N − 1) | V/(N − 1) | V/(N − 1) | V/(N − 1) |

For smaller teeth, the maximum tooth spacing T can be divided by a whole number, e.g., 2 or more, to obtain t.

Furthermore, as indicated above, the angled planar tooth surfaces 53 of the preferred teeth in combination with the pivotal mounting of the driving piston/cylinders 33 permit the generation, by the engaged teeth of the rack engagement members 34 and toothed racks 32, of forces that resist disengagement of the rack engagement members 34 from the toothed racks 32 when the piston/cylinder units 33 are in their retracted positions in the locking mode of operation of the system, and forces assisting disengagement of the rack engagement members 34 from the toothed racks 32 when the piston/cylinder units 33 are fully extended and ready for disengagement and repositioning during their operation in the jack-up or jack-down modes.

Figure 12:
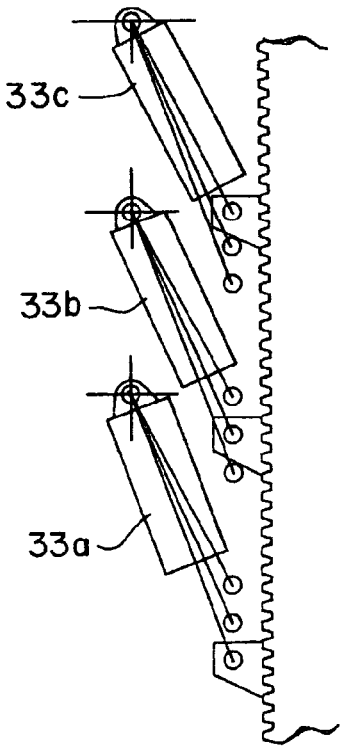
FIGS. 12–15 diagrammatically illustrate how the pivotal attachment of a driving piston/cylinder unit to the MODU combines with the preferred tooth profile of FIG. 11 to provide an application of driving force uniformly and normally on the teeth with the piston at mid-stroke (FIG. 14), and to generate forces resisting the disengagement of the teeth when the pistons are retracted and the MODU is in its locking mode (FIG. 13), and to generate forces assisting the disengagement of the teeth when the pistons are at the end of their stroke (FIG. 15).
Figure 15:
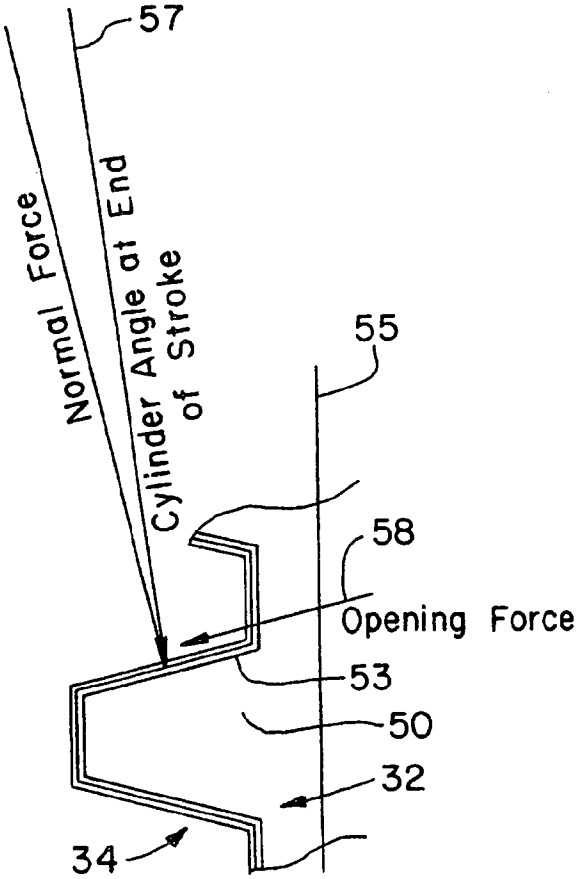
Figure 14:
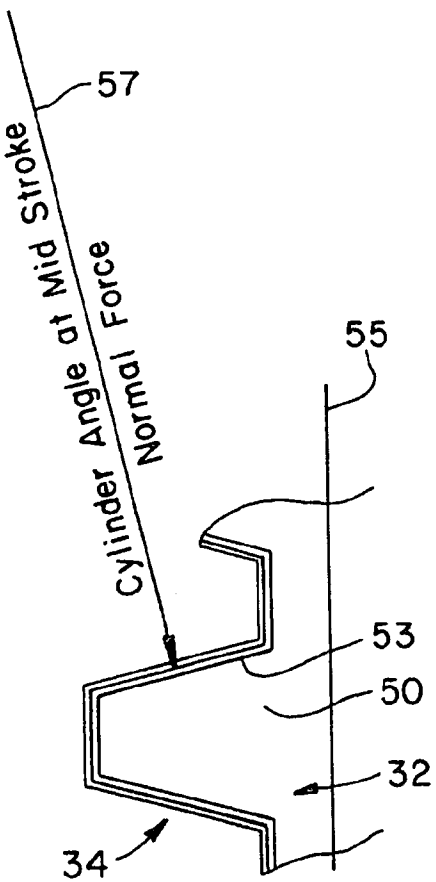
Figure 13:
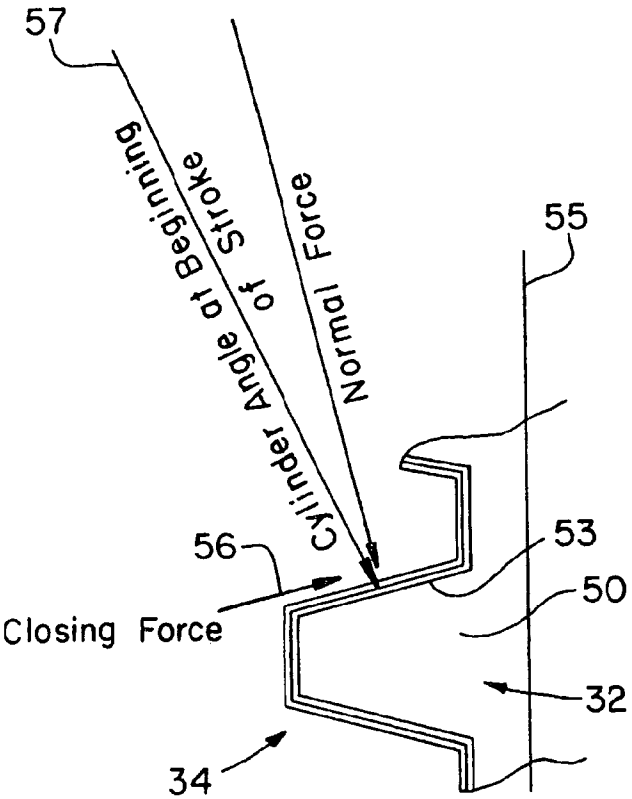

The cooperation of the angled planar tooth engagements surfaces 53 of the preferred teeth 50 with the pivotal attachment of the piston/cylinder units 33 is illustrated in FIGS. 12–15. FIG. 12 illustrates three piston/cylinder units 33*a*, 33*b*, and 33*c* with their pistons fully extended, at mid-stroke and fully retracted respectively, and FIGS. 13, 14 and 15 illustrates the force vectors at the engaged planar tooth engagement surfaces 53 of the toothed racks 32, with FIG. 13 representing the force vectors corresponding to the position of piston/cylinder units 33*c*, FIG. 14 representing the force vectors corresponding to the position of piston/cylinder units 33*b*, and FIG. 15 representing the force vectors corresponding to piston/cylinder units 33*a*.

As shown in FIG. 13 with the pistons of the piston/cylinder units retracted (as with piston/cylinder unit 33*c* of FIG. 12) and the preferred teeth 50 of the toothed rack engagement members 34 and the toothed racks 32 engaged, a closing force vector 56 is generated urging the toothed rack engagement members 34 toward the toothed racks 32 to assist in maintaining their engagement and in locking the MODU platform 21 in a stationary position with respect to the MODU supporting legs during the locking mode of the jacking system.

As shown in FIG. 14, when the piston/cylinder units are in mid-stroke (as with the piston/cylinder unit 33*b* of FIG. 12), the force vector 57 resulting from the pistons of the piston/cylinder units is perpendicular to the planar engagement surfaces 53 of the toothed racks 32.

As shown in FIG. 15 with the pistons of the piston/cylinder units fully extended (as with the piston/cylinder unit 33*a* of FIG. 12) an opening force vector 58 is generated urging the toothed rack engagement members 34 away from the toothed racks 32. The opening force 58 must be resisted by the compression springs of the preferred engagement/disengagement means 35 but will assist in the disengagement of the toothed rack engagement members 34 prior to their retraction and re-engagement.

As the mobile offshore structure 22, 29 is lowered in the jack-down mode at a rate controlled by the plurality of piston/cylinder units 33, the upward forces generated by the resistance of the pistons in controlling the lowering of the mobile offshore structure 22, 29 will generate, by the engagement of the lower angled toothed surfaces 54 of the toothed racks 32 with the corresponding mated surfaces of the rack engagement members 34, an opening force (like force 58) acting to disengage the rack engagement members 34 from the toothed racks 32, and such forces must be overcome by the forces exerted by the compression springs of the engagement/disengagement means 35 that maintain the rack engagement members 34 in engagement with the toothed racks 32. These opening forces acting to disengage the rack engagement members 34 from the toothed racks 32 as the mobile offshore structure 22, 29 is lowered can be reduced by increasing the tooth angle $\alpha 2$ of the lower planar engagement surfaces to be, for example, more substantially normal to the vertical plane 55.

The hydraulic system will, preferably, use a pressure compensated variable volume hydraulic pump or pumps for generation of the hydraulic pressure, enabling the speed of movement of the pistons to be controlled. In addition, over center valves may be used to require the presence of positive hydraulic pressure at the cylinders before the pistons are moved in the jack down mode. The jacking system will, as apparent to those skilled in the art, also include the controllable hydraulic valves necessary to control the sequenced application of hydraulic fluid and pressure to the piston/cylinder units 33 and the unclamping piston/cylinder units of the preferred engagement/disengagement means 35, accumulators, if needed, to accelerate the operation of the pistons of the piston/cylinder units 33, and direction flow valves, relief valves, load cells and motion sensors, as needed.

As noted above, the piston/cylinder units of the continuous linear motion motors for each supporting leg can be connected to a common hydraulic fluid supply line so that the same hydraulic pressure is exerted on all the piston/cylinder units acting on that leg. Thus, any resistance to movement of one leg chord of a supporting leg will increase the pressure and forces acting on all of the leg chords of the supporting leg and tend to maintain uniform motion of all of the leg chords.

As set forth above, the invention provides a method of locating a source of electricity to take advantage of winds traveling over water, comprising providing a structure that can be transported over water, providing one or more wind-driven sources of electricity carried by said structure, providing structure-supporting means carried by said structure for engaging the earth's surface under water, transporting the structure to an advantageous location for operation of the wind-driven sources of electricity, engaging said structure-supporting means with the underwater earth's surface at the advantageous location and elevating the one or more wind-driven sources of electricity to take advantage of the winds traveling over the water.

The invention also provides a new mobile offshore wind-driven electric generating system with a preferred jacking system that can reliably handle loads several times greater than can be currently handled, can be readily and inexpensively designed and scaled for different jack-up loads, and can save millions of dollars in the manufacture of a single mobile offshore wind-driven electric generating apparatus.

Furthermore, the mobile offshore wind-driven electric generating system of the invention is less expensive to install than monopole structures and permanent structures, is movable at any time for repair, modification, reinstallation of electrical generators and for repositioning within a wind farm or to take advantage of seasonal shifts in the wind, creates less damage to the environment, permits the generation of power directly at sites of offshore manufacturing, for example, for fresh water, hydrogen, PV, etc.

The preferred jacking system for the mobile offshore structure provides, as indicated above, jack-up, jack-down and locking modes of operations and permits monitoring and control of leg loads and the rates of relative movement. Operation of the jacking system, in the invention, is preferably controlled by a programmable logic computer, which can control operation of one or a plurality of sources of hydraulic pressure, operation of each of the continuous linear motion motors driving each of the toothed racks of each of the supporting legs by sequencing the operations of valves controlling the flow of hydraulic fluid and the application of hydraulic pressure to the piston/cylinder units of the motors, and by controlling the rates of relative motion. The computer control can also sequence operation of the valves and piston/cylinder units to position the pistons and toothed rack engagement members of the continuous linear motion motors for providing motion, in changing from the locking mode to the jack-up or jack-down modes, and can cease motion of the pistons of the piston/cylinder units of the continuous linear motion motors and sequentially retract their pistons and engage their rack engagement members in changing from the jack-up or jack-down modes to the locking mode.

In addition, the computer control can also monitor the output signals of load cells sensing the loads on each of the leg chords of each of the supporting legs and/or outputs of motion sensors sensing the rate of movement of each of the leg chords of each of the supporting legs and can provide quantitative read-outs thereof and warnings of unacceptable operating conditions.

The description and illustrations of the invention presented here are of specific preferred embodiments and simplified examples. As will be apparent to those skilled in the art, the invention is not limited to the specific embodiments described and illustrated, but is defined in its scope by the following claims.

What is claimed is:

1. A method of locating a wind-driven source of electricity over water, comprising providing a structure that can be transported over water, providing one or more wind-driven sources of electricity carried by said structure, providing structure-supporting means carried by said structure for engaging the earth's surface under water, transporting the structure to an advantageous location for operation of the one or more wind-driven sources of electricity, engaging said structure-supporting means with the underwater earth's surface and installing such structure at the advantageous location, and elevating the one or more wind-driven sources of electricity with said structure to take advantage of the winds traveling over the water.

2. The method of claim 1 wherein said structure-supporting means comprises a plurality of structure-supporting legs movably carried by said structure and engagable with the earth's surface underwater by providing relative motion between said structure-supporting legs and said structure.

3. The method of claim 2 wherein the one or more wind-driven sources of electricity are elevated to take advantage of the winds traveling over the water by providing relative motion between the structure-supporting legs and the structure.

4. The method of claim 2 wherein said structure comprises a central portion and a plurality of outwardly extending portions, each of said outwardly extending portions movably carrying one of the plurality of structure-supporting legs and one of the wind-driven sources of electricity.

5. The method of claim 1 wherein the structure-supporting means is engaged with the earth's surface underwater by phased operation of a plurality of hydraulic piston/cylinder units so that a portion of the plurality of hydraulic piston/cylinder units is providing continuous relative motion between said structure and said structure-supporting means while at least one of the plurality of hydraulic piston/cylinder units is being positioned to thereafter provide continuous relative motion between said structure and the structure-supporting means.

6. The method of claim 1 further comprising providing the structure with a plurality of wind-driven sources of electricity, and separating the plurality of wind-driven sources of electricity on the structure to reduce their mutual interference in operation.

7. The method of claim 6 wherein the structure is elevated by a plurality of supporting legs, with at least one leg being operatively associated with each of the plurality of wind-driven sources of electricity.

8. The method of claim 3, wherein the relative motion between said structure and said plurality of supporting legs is provided by engaging and operating at least one linear motion motor with each of the plurality of supporting legs.

9. A method of providing an offshore wind farm over deep water, comprising:

providing at least one mobile offshore structure carrying one or more wind-driven sources of electricity and a plurality of movable structure supporting legs, transporting the at least one mobile offshore structure to the site of the offshore wind farm over deep water, moving the at least one mobile offshore structure at the site of the wind farm for advantageous installation and operation of its one or more wind-driven sources of electricity, moving the movable structure supporting legs into engagement with the underwater earth's surface for installation of the one or more wind-driven sources of electricity, and thereafter elevating the one or more wind-driven sources of electricity to an elevation for operation by the winds at their installed location.

10. The method of claim 9, wherein the elevation of said one or more wind-driven sources of electricity is changed at their location.

11. The method of claim 9, wherein said one or more wind-driven sources of electricity are relocated by lowering the structure onto the water with said plurality of movable structure supporting legs, moving the structure to a different location, and engaging the plurality of movable structure supporting legs with the underwater earth's surface at said different location.

12. The method of claim 9, wherein the one or more wind-driven sources of electricity are transported to a location where the water is more than 60 feet deep for installation and operation.

13. A method of creating a wind farm with a plurality of wind-driven electric generators, comprising selecting an offshore wind farm site, providing one or more offshore structures that can be transported over water, each of said one or more offshore structures carrying at least one wind-driven source of electricity and a plurality of movable structure-supporting legs adapted to be moved relatively with respect to their one of said one or more offshore structures, transporting said one or more offshore structures over water to the offshore wind farm site, moving each of said one or more structures at the offshore wind farm site to a location for individual operation without interference with the others, engaging the plurality of structure-supporting legs of each of said one or more offshore structures with the underwater earth surface at its location, and elevating the wind-driven sources of electricity of said one or more offshore structures over the water to take advantage of the winds at the offshore wind farm site.

* * * * *